US008777148B2

(12) United States Patent
LaGarde et al.

(10) Patent No.: US 8,777,148 B2
(45) Date of Patent: Jul. 15, 2014

(54) CORD WINDER FOR A WINDOW-COVERING DEVICE

(75) Inventors: Eric LaGarde, Sallanches (FR); Norbert Dupielet, Sallanches (FR)

(73) Assignee: Somfy, SAS, Cluses (FR)

( * ) Notice: Subject to any disclaimer, the term of this patent is extended or adjusted under 35 U.S.C. 154(b) by 0 days.

(21) Appl. No.: 13/636,291

(22) PCT Filed: Mar. 22, 2011

(86) PCT No.: PCT/EP2011/054336

§ 371 (c)(1), (2), (4) Date: Sep. 20, 2012

(87) PCT Pub. No.: WO2011/117232

PCT Pub. Date: Sep. 29, 2011

(65) Prior Publication Data

US 2013/0001347 A1 Jan. 3, 2013

(30) Foreign Application Priority Data

Mar. 23, 2010 (FR) ..... 10 52075

(51) Int. Cl.
*B65H 75/48* (2006.01)
*E06B 9/306* (2006.01)

(52) U.S. Cl.
USPC ..... 242/388; 160/170

(58) Field of Classification Search
CPC ..... B65H 75/48; E06B 9/306; E06B 9/307; E06B 9/308; E06B 9/28; E06B 9/322; E06B 2009/3225
USPC ..... 242/388, 547, 422.5; 160/170, 171, 160/193, 319, 320, 322
See application file for complete search history.

(56) References Cited

U.S. PATENT DOCUMENTS

| | | | | |
|---|---|---|---|---|
| 3,145,939 | A * | 8/1964 | Mason et al. | 242/474.8 |
| 5,228,491 | A * | 7/1993 | Rude et al. | 160/171 |
| 5,328,113 | A | 7/1994 | De Chevron Villette et al. | |
| 5,332,438 | A * | 7/1994 | Ueda et al. | 118/65 |
| 5,645,118 | A * | 7/1997 | Lagarde | 160/170 |
| 5,725,040 | A | 3/1998 | Domel | |
| 7,137,430 | B2 | 11/2006 | Fraczek | |
| 7,159,635 | B2 | 1/2007 | Holt et al. | |
| 7,210,646 | B2 * | 5/2007 | Hsu | 242/397 |
| 7,370,683 | B2 | 5/2008 | Numajiri | |
| 7,441,722 | B2 * | 10/2008 | Mancuso et al. | 242/422.5 |
| 7,686,059 | B2 * | 3/2010 | Jarosinski et al. | 160/84.03 |
| 8,230,896 | B2 * | 7/2012 | Anderson et al. | 160/170 |
| 2005/0051283 | A1 * | 3/2005 | Chatellard et al. | 160/265 |

* cited by examiner

*Primary Examiner* — William A Rivera
(74) *Attorney, Agent, or Firm* — Frommer Lawrence & Haug LLP; Ronald R. Santucci

(57) ABSTRACT

The invention relates to a cord winder (1) for a window-covering device, said cord winder including: a drum (7) for winding a cord (40), said drum being rotatable around a first rotationally symmetrical axis (A-A'); and a means (12, 13*b*) for guiding the cord to the winding drum, the winding drum being rotatably mounted in a holder (2). Said cord winder is characterized in that it includes a rotatable roller (14) that is mounted onto the holder along a second rotationally symmetrical axis (B-B'). Said cord winder is moreover characterized in that it includes a friction area (23) wherein at least one coil of the cord, wound onto the winding drum, is in contact with the rotatable drum.

16 Claims, 3 Drawing Sheets

Fig. 1
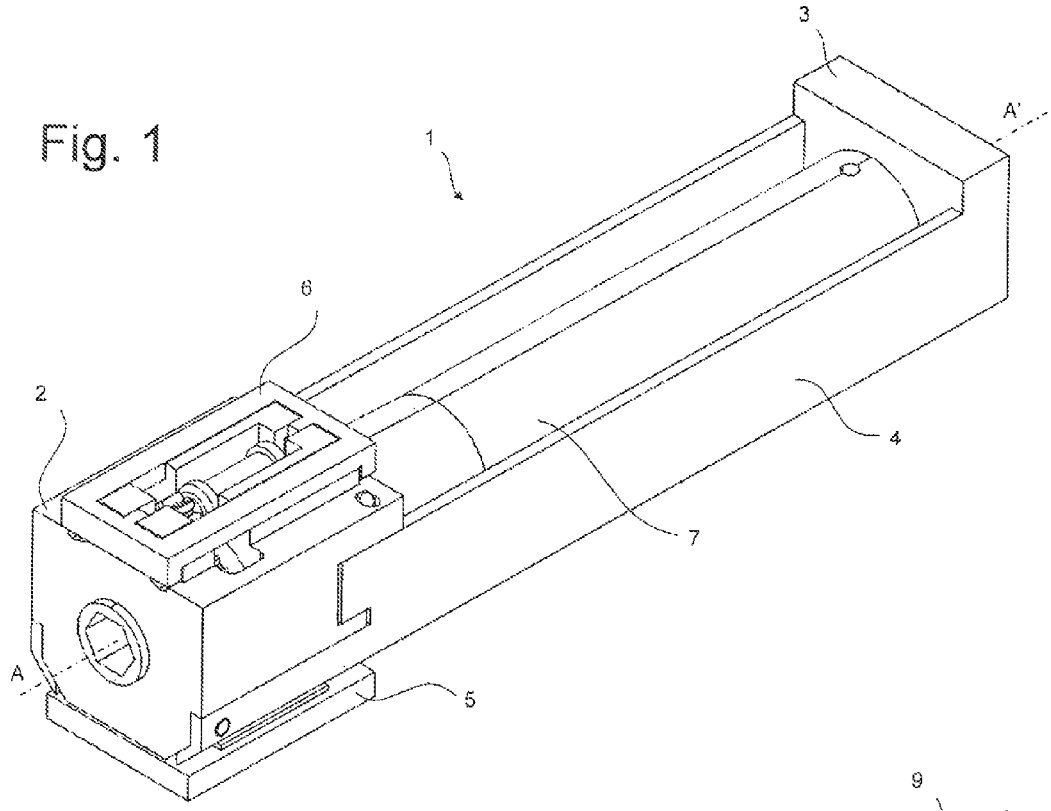
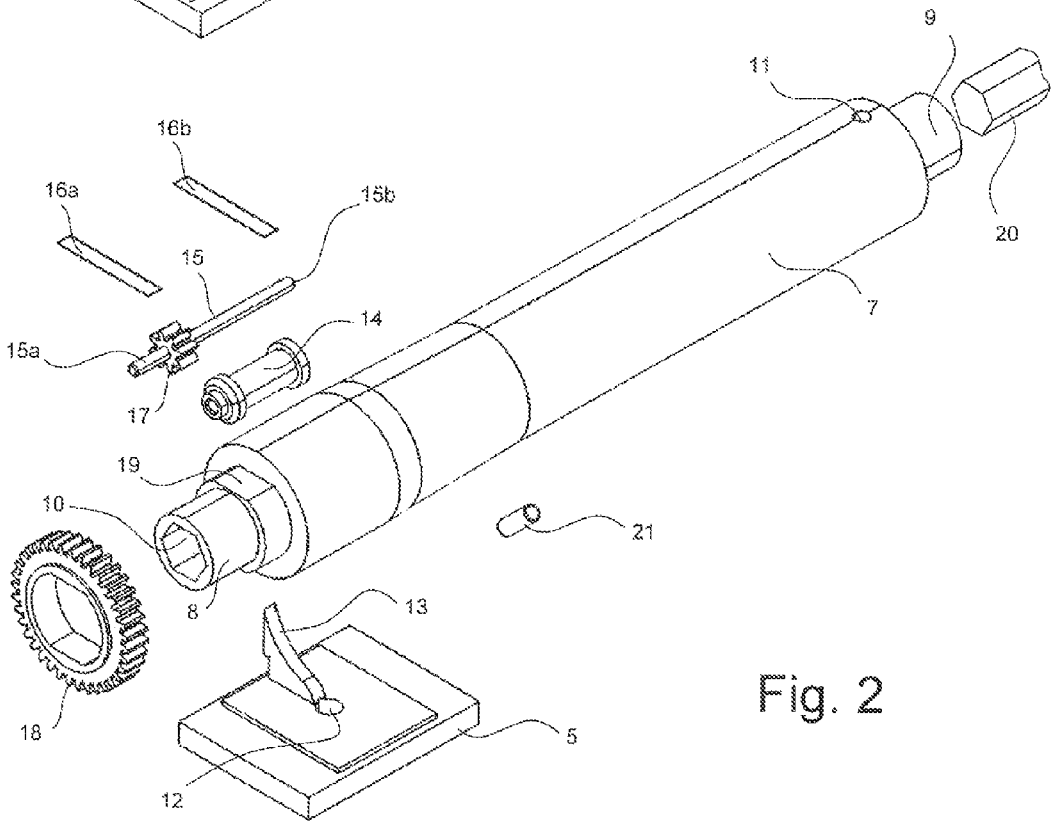
Fig. 2

CORD WINDER FOR A WINDOW-COVERING DEVICE

This application is a 371 of PCT/EP2011/054336 filed on Mar. 22, 2011, published on Sep. 29, 2011 under publication number WO 2011/117232, which claims priority benefits from French Patent Application Number 10/52075 filed Mar. 23, 2010, the disclosure of which is incorporated herein by reference.

The invention concerns a cord winder for window covering devices.

A cord winder is fitted to solar protection, screening or decoration devices disposed in front of glazed window openings and designated "window covering devices". These devices are of Venetian blind, Roman blind, pleated blind, cellular shade or "Roman shade" type. In a typical configuration of such a device, a plurality of cord winders are disposed in a casing and can be driven simultaneously by a common drive shaft rotated manually or by an electric motor. The cords are attached by one end to a load bar while the screening, decoration or solar protection product is deployed in the space between the load bar and the casing. The visible area of the product is proportional to the unwinding of the cord.

The prior art describes very many ways of producing cord winders intended for this type of device. A real step change in this field was the introduction of cord winders having from the functional point of view a cord winding area and elements for pushing the wound turns toward a wound turns storage area, in which area the tension in the turns of cord becomes substantially zero.

By virtue of a physical effect known as the "capstan effect", the tension of the cord on a drum tends to decrease between a newly wound turn and a previously wound turn. However, this effect is insufficient to enable regular pushing of numerous turns on a purely cylindrical winding drum. The turns wound first tend to become immobilized on the drum and the new turns cannot be inserted by pushing them. There is then overlapping of the turns. To prevent such overlapping occurring, the capstan effect has been accentuated by additionally causing a progressive or sudden variation in the diameter of the winding drum.

U.S. Pat. No. 5,328,113 describes one such device, providing a variation in diameter between a winding area and a storage area.

U.S. Pat. No. 5,725,040 describes elements for pushing the turns by means of a finger external to a winding drum.

Cord winders are for the most part fitted with a winding drum having a conical profile in the winding area.

However, there remains a problem linked primarily to the load bar encountering an obstacle during a phase of unwinding the cord. In this situation the cord is no longer tensioned by the weight of the load bar. If the rotation moment of the drum in the unwinding direction continues, the cord tends to generate loose turns the diameter of which increases. These turns can then overlap and become entangled. The situation is not improved if the obstacle suddenly disappears: some winders of the device may revert to a normal configuration while others remain in a situation with jammed turns, causing a slanting appearance of the load bar, which cannot be compensated by a reverse winding movement. There is moreover the risk of wear and breaking of the cord.

The situation of an obstacle is relatively rare, but the same phenomenon may occur if the window covering device is guided by side channels, for example in the event of a "hard spot" in a side channel.

A number of prior art documents attempt to remedy this kind of situation by adding a cover above the drum so as to leave a limited space between the drum and the cover. The aim of this is to prevent the diameter of the turns of the cord increasing during unwinding when the load applied to the cord is no longer sufficient. U.S. Pat. Nos. 7,137,430 and 7,159,635 describe such solutions.

U.S. Pat. No. 7,159,635 also describes cord fixing elements mobile along the winding drum, as also described in U.S. Pat. No. 7,370,683.

These solutions improve the conditions under which the cord is unwound but may not suffice to oblige the cord to leave the cord winder if tension is no longer applied to it by the load bar. There then remains the problem referred to above, in a more or less serious form.

The problem is also occasionally manifested during a winding phase should it happen that a movement of an occupant of the room relieves the weight of the load the prior art devices are unable to wind up a cord when it is not under tension. This constraint often leads to increasing the weight of the load bar and this is reflected in an unnecessary consumption of energy and the necessity to overspecify any drive motor.

Finally, such false movements of the load bar may also occur in the absence of a winding or unwinding maneuver, and cause the cord to rise in the winder and turns to overlap, for example. Such false movements may occur during when cleaning the premises or the windows.

There exists a requirement for cord winders having absolutely total reliability. This is notably the case for window covering devices disposed between the two panels of sealed glazing units, where even the slightest malfunction of the cord winder is not allowed. In this case false movements are not a concern, but the problems referred to above may simply arise from hard spots occurring over time in the guide side channels of the device.

The object of the invention is to provide a cord winder that remedies the shortcomings referred to above and improves on the known cord winders of the prior art. In particular, the invention makes it possible to improve the winding and the unwinding of a blind suspension cord and to prevent all risk of tangling thereof.

According to the invention, the cord winder for a window covering device comprises a drum for winding a cord adapted to be driven in rotation about a first revolution axis, an element for guiding the cord toward the winding drum, the winding drum being mounted to be mobile in rotation in a support. The winder comprises a rotary roller mounted on the support to rotate about a second revolution axis and comprises a friction area in which at least one turn of the cord wound on the winding drum is in contact with the rotary roller.

The rotation of the rotary roller may be slaved to the rotation of the winding drum by a slaving element.

The slaving element may comprise a first pinion constrained to rotate with the winding drum and meshing with a second pinion constrained to rotate with the rotary roller.

In the friction area, the rotary roller may apply pressure to at least a first turn of the cord wound onto the winding drum, for example the first turn and another turn or the first turn and two other turns.

The cord winder may comprise an element for orienting the cord fastened to the support and disposed in the vicinity of the friction area in the direction away from the guide element and at least two turns of cord of a final turn in contact with the rotary roller.

The number of turns in the friction area may be independent of the state of winding or of unwinding of the cord.

A pushing element may act at least on the turns in contact with the rotary roller to move them away from the guide element.

The pushing element may comprise a helical wall.

The helical wall may be formed in a cylindrical bore of the support, said cylindrical bore containing at least the friction area, and the helical wall may be at least partially interrupted by a housing of the rotary roller The rotary roller may comprise two shaft ends belonging for example to a secondary shaft and guided in the support, notably by two straight grooves provided in the support.

A pressing element may push the rotary roller toward the drum.

The pressing element may comprise an elastic element of the support in contact with a shaft end of the rotary roller.

The rotary roller may comprise an elastomer coating and/or a friction coating.

At most five consecutive turns of the cord may be in tangential contact with the rotary roller.

The cord may be guided toward the winding drum by a central face of a finger engaged in the support or belonging to the support.

The invention will be better understood on reading the following description, given by way of example only and with reference to the appended drawings, in which:

FIG. 1 is an isometric view of a cord winder of one embodiment of the invention.

FIG. 2 is a partial exploded isometric view of this embodiment of the cord winder.

Figure 3:
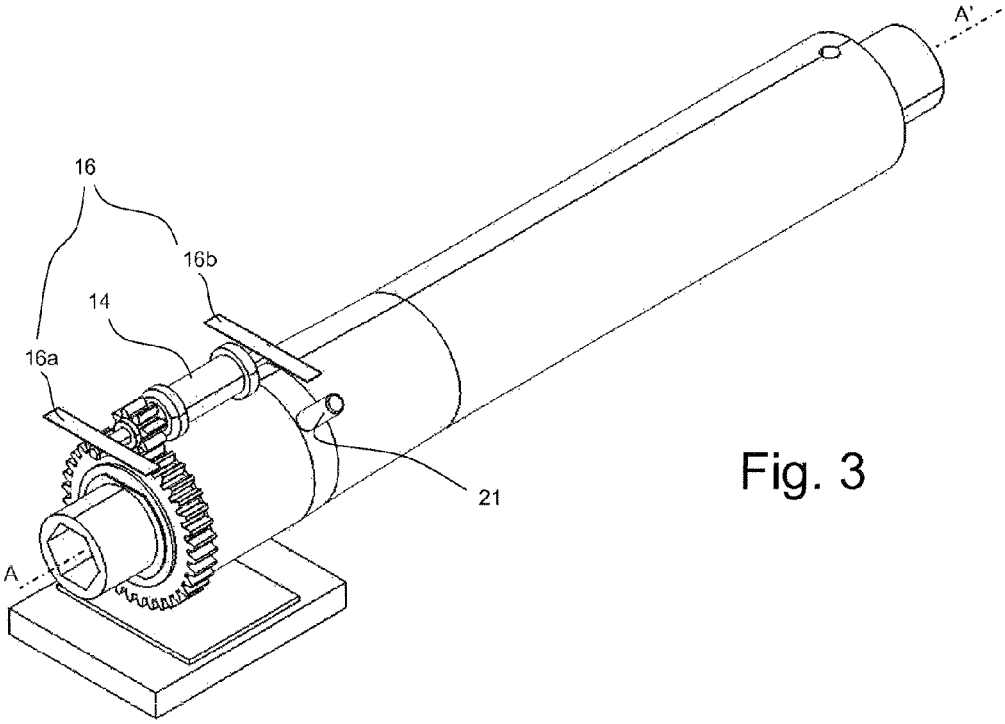
FIG. 3 is a view of the FIG. 2 components when assembled.

The invention very significantly improves on prior art cord winders for window coverings by the use of a rotary roller disposed in direct contact with the first wound turns of the cord.

FIG. 1 is an isometric view of a cord winder 1 of the invention. As in the prior art described, the cord winder is designed to wind a cord 40 and to be disposed in a casing of a window covering device, not shown.

It comprises a support 2 forming a first bearing and a second bearing 3 connected to the support by a cradle 4. The support is fixed to a base 5. A frame 6 is mounted on the support in order to enable the assembly of a plurality of parts onto the support. A winding drum 7 is supported by the support and by the second bearing and is mobile in rotation about a first rotation axis AA'. Alternatively, the support also forms the base.

FIG. 2 is a partial exploded isometric view of the cord winder and FIG. 3 shows the FIG. 2 components when assembled.

The winding drum comprises a first ring 8 and a second ring 9 that are coaxial with the first rotation axis and engaged in the first bearing and the second bearing, respectively. These rings are smooth on the outside so as to turn in the bearings and include a polygonal opening 10 adapted to enable the engagement of a drive shaft 20 for transmitting a rotation movement to the winding drum. The drive shaft has a hexagonal profile, for example.

Alternatively, the bearings are not essential. For example, the second bearing is not essential because the centering of the winding drum on the first rotation axis may be assured by the drive shaft.

In the same way, the support need not form a first bearing when the centering of the winding drum on the first rotation axis is assured by the drive shaft, provided that the support is accurately positioned relative to the winding drum.

The winding drum comprises an element 11 for attaching a cord to the winding drum, for example in the form of a hole for trapping a knot produced in the cord once it has been inserted in the hole. Alternatively, the cord attachment element is mobile axially along the winding drum whilst being prevented from rotating relative to it.

An element 12 for guiding entry of the cord into the winder, for example a cord entry hole guiding the cord toward the winding drum, is disposed on the base 5, in the vicinity of a finger 13. The finger 13 may comprise a first element 13*a* for pushing on the cord, as described hereinafter. Alternatively, the first pushing element may comprise a shoulder produced on one end of the winding drum.

The guide element may comprise a small pulley or alternatively two rollers with mobile and substantially perpendicular axes in order to guide the entry of the cord into the cord winder whilst limiting rubbing.

A rotary roller 14 mobile in rotation about a second rotation axis B-B' substantially parallel to the first rotation axis is disposed in the support in the vicinity of the winding drum, the guide element and the first pushing element, as explained hereinafter.

This rotary roller is fitted onto a secondary shaft 15 having a first secondary shaft end 15*a* and a second secondary shaft end 15*b*. Alternatively, the rotary roller may be extended by axial pegs forming the first shaft end and the second shaft end. The role of the rotary roller is to apply friction to the cord. A pressing element 16, preferably of elastic type, is such that the rotary roller applies pressure to one or more turns of the cord wound onto the winding drum.

This means that one or more turns of the cord are in circumferential contact with the winding drum and also in tangential contact with the rotary roller, the tangential contact being of the pressing type and causing friction on the cord.

For example, the pressing element exerts a thrust on the rotary roller so that it is urged toward the winding drum in contact with the wound turns of the cord. Accordingly, a first elastic element 16*a* (such as a steel leaf spring) and a second elastic element 16*b* come to bear elastically on the first end of the secondary shaft and the second end, respectively. The two elastic elements constitute the elastic pressing element 16 enabling the rotary roller to drive by friction turns wound on the winding drum.

A first pinion 17 is constrained to rotate with the secondary shaft and a second pinion 18 is constrained to rotate with the winding drum. The second pinion is mounted on a bearing surface of the drum provided with a flat 19, for example, preferably forcibly engaged with the bearing surface of the drum provided with the flat 19. The first pinion meshes with the second pinion. The role of the pinions is described hereinafter.

An element 21 for orienting the cord is constituted for example by a cylindrical pin the axis of the cylinder of which is oriented in a direction at least substantially radial with respect to the winding drum. The orientation element is fixed to the support. The radial distance between the orientation element and the winding drum is very much less than the diameter of the cord. This orientation element may be mounted so as to be mobile in rotation about the radial direction. The role of the orientation element is described hereinafter.

Figure 4:
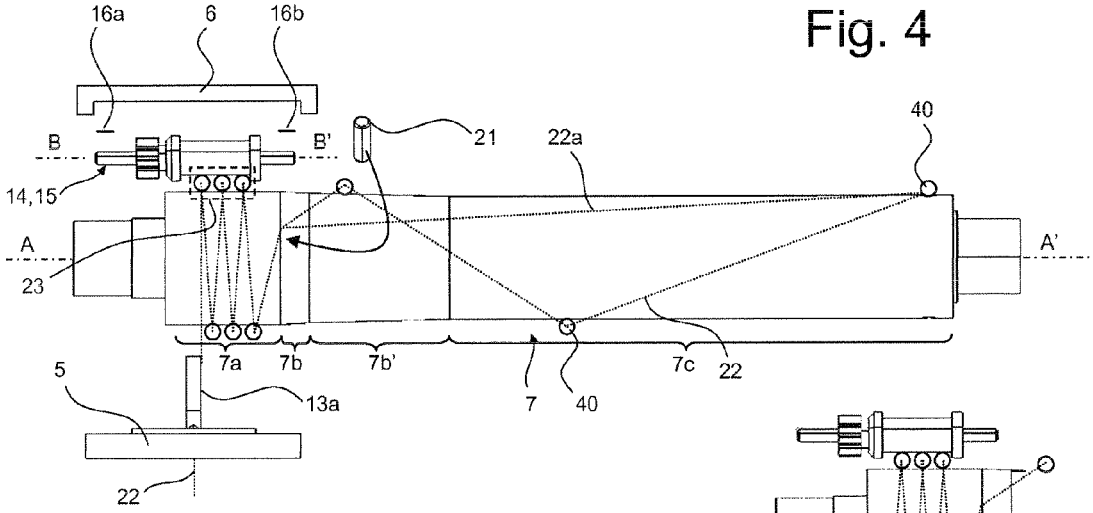
FIG. 4 is a side view of the FIG. 2 components when partially assembled.

FIG. 4 is a side view of the elements from FIG. 2 when partially assembled with a diagrammatic representation of the cord 40, a plurality of turns of which have been wound on, and with a dotted line 22 showing a path in the winder.

The expression "first turn" refers to a first turn of the cord in contact with the winding drum on moving along the cord from the element 12 for guiding entry of the cord into the winder.

In this side view, it is clearly apparent that the winding drum includes at least:

- a first area 7*a*, called the winding area, situated in the vicinity of the support, comprising at least the first turn and comprising a friction area 23 in which a plurality of turns of the cord are in contact with the winding drum and also with the rotary roller; then, moving away from the support:
- a second area 7*b* and/or 7*b*', called the intermediate area, in which the diameter of the winding drum is reduced; then, moving away from the support:
- a third area 7*c*, called the storage area, having a diameter less than that of the winding area, at least where it is connected to the intermediate area.

The winding area 7*a* is thus a portion of the winding drum comprising a first turn of the cord and comprising the friction area 23 in which at least one turn of the cord is in circumferential contact with the winding drum and also in tangential contact with the rotary roller. The winding area may have an axial length greater than the axial size of the friction area, as in FIG. 4.

The winding area preferably has a constant diameter. In this case, the secondary shaft and the rotary roller have a second rotation axis B-B' parallel to the first rotation axis A-A'. Alternatively, the winding area may feature a regular and slight decrease in diameter (a few hundredths of a millimeter per millimeter) in the direction toward the intermediate area.

This slightly conical geometry may be favorable to an operation of extraction from a mold. It may also make it possible to encourage the capstan effect.

The winding drum may include no shape discontinuity, for example be formed of a conical part of revolution, the diameter of which decreases regularly on moving away from the guide element. In this case, the winding area extends over all of the axial length of the winding drum.

In the case of a conical profile of the winding area, the second rotation axis is parallel to the side of the cone. The second rotation axis thus remains substantially parallel to a generatrix of the winding area, which generatrix may be parallel to the first rotation axis (cylindrical winding area) or slightly inclined relative to that axis (conical winding area).

The winding drum is preferably smooth, so as to have as low as possible a coefficient of friction, notably in the axial direction.

The friction between the rotary roller and the cord is the result of the action of the pressing element. The leaf springs exert a force on the secondary shaft to push the rotary roller in the direction of the winding drum and to rub on the turns situated in the friction area. Alternatively, the secondary shaft is fixed and the pressing roller comprises an elastically deformable covering adapted to exert an elastic pressure on the cord and then constituting the elastic pressing element.

The pressing element is preferably formed by a combination of elastic leaf springs and elastically deformable coating, for example an elastomer coating.

In one variant, the friction between the rotary roller and the cord is the result of the action of gravity, the rotary roller then being produced in a material of high density. A friction coating or a surface treatment may also make the friction between the roller and the cord sufficient without it being necessary to use an elastic pressing element. The radial elasticity of the cord may also be exploited to avoid the necessity for the elastic pressing element.

The orientation element 21 is disposed on the support, at the exit from the winding area. It enables correct exit of the cord toward the storage area to be guaranteed in the case of winding and correct entry of the cord into the winding area to be guaranteed in the case of unwinding.

Where it enters the cord winder, the cord is pushed axially in the direction of the surface area by a lateral surface of the finger 13 constituting the first pushing element 13*a*. Accordingly, if the turns are contiguous, a new turn tends to push the turns already wound on in the direction of the storage area.

Conversely, during unwinding, the friction between the rotary roller and the cord enables the last turn wound on to be pushed in the direction of the guide element 12 and thus the cord to be pushed out of the cord winder, which solves the problem afflicting the prior art.

However, operation is greatly improved by introducing an element for slaving the rotation of the rotary roller to that of the winding drum. This slaving element comprises the first and second pinions already described. If the demultiplication ratio is substantially equal to the ratio of the respective diameters of the winding drum and the rotary roller, then these two elements have substantially the same tangential speed, which speed is communicated to the cord to cause it to exit or to enter the cord winder even in the absence of tension in the cord.

In the case of a winding area in which the diameter of the drum changes (conical area), the roller may also be conical so that the tangential speeds of the drum and the roller are the same in any cross section of the winding area in which the roller is located. The second rotation axis is then inclined more than the generatrix of the winding area relative to the first rotation axis.

The winding drum can take numerous forms, provided that it comprises a friction area as defined above.

For example, the storage area 7*c* may have a conical profile of slightly increasing diameter in the direction away from the guide element. If the element for attaching the cord is fixed, then the diameter of the turns increases when they are pushed toward the attachment element.

Moreover, operation is greatly improved by the use of second pushing element described hereinafter.

Figure 5:
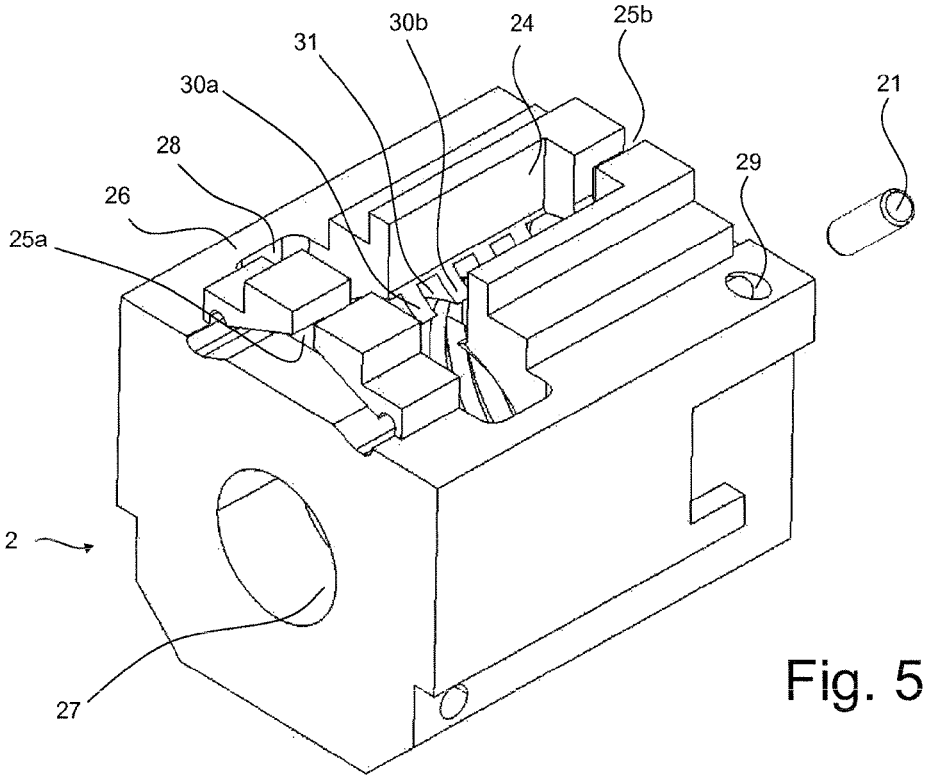
FIG. 5 is an isometric view of a bearing of this embodiment of the cord winder.

FIG. 5 is an isometric view of the support 2.

A housing 24 in the upper part of the support accommodates the rotary roller. A first straight groove 25*a* and a second straight groove 25*b* serve as guides for the first shaft end 15*a* and the second shaft end 15*b*, respectively, of the secondary shaft. A top flat 26 receives the frame 6 enabling final assembly of the secondary shaft and the leaf springs in the support.

A circular hole 27 is designed to receive the first ring 8 of the rotary drum, to provide the bearing function. A recess 28 accommodates the first and second pinions. A radial hole is formed to receive the pin 21 serving as orientation element.

The support also comprises a cylindrical bore 33 comprising a helical groove 31 interrupted at the level of the housing 24.

Figure 6:
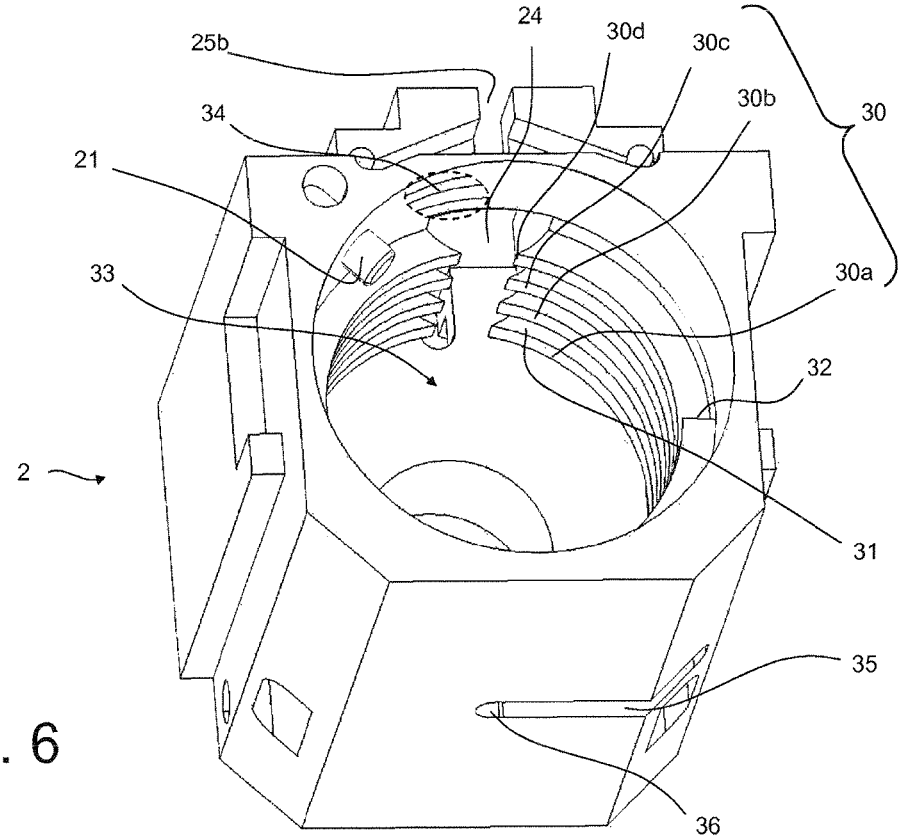
FIG. 6 is an interior view of a bearing.

FIG. 6 is an interior view of the support. The cylindrical bore 33 has a diameter greater than the diameter of the winding area. Thus the winding area penetrates into the interior of the support.

Moreover, machining of the support or other technical elements enables the production of the helical groove in which the cord travels. This helical groove is delimited by a helical wall 30. Four sections 30*a*-30*d* of the helical wall are visible in the housing 24, which interrupts the helical wall.

Also seen in FIG. 5 are a plurality of sections 30*a*, 30*b* of the helical wall resulting from this interruption of the helical wall by the housing 24.

In contrast to the prior art, the turns of the cord are no longer contiguous in this case. The helical wall thus serves as a second element for pushing the turns toward the storage area in the case of winding.

Conversely, the helical wall serves also as an element for pushing the turns toward the guide element in the case of unwinding.

The depth of the helical groove is greater than the radius of the cord.

The interruption of the helical wall at the level of the housing 24 may be only partial, the wall being continuous in the region of its smaller diameter and interrupted only in the region of its larger diameter to enable the action of pressing the rotary roller onto the cord.

The helical wall is preferably formed around the drum only at the level of the friction area.

The helical wall is preferably only partly interrupted at the level of the housing, and forms an independent one-piece part inserted, for example screwed, into the bore 33. The area 34 includes part of a screwthread produced in the bore 33 of the support. The thread may have the same pitch as the helical wall and the latter (which comprises many fewer turns than the thread in the bearing and the shape of the section of which is different from that of the thread) is screwed into place.

A termination 32 of the helical wall is situated beyond the friction area. According to the invention, the helical wall may extend axially over all of the length of the winding area, but it is preferable for it to act on no more than one turn outside the friction area. The termination is thus situated, in the direction toward the storage area, at less than one turn from the last turn in the friction area: for example three quarter-turns in FIG. 6.

Starting from this termination, the orientation element is itself situated less than one half-turn from the termination, to enable the actions of orientation of the cord described above.

This orientation element is thus disposed less than two turns from the last turn of the friction area, preferably less than 1.5 turns.

In FIG. 6 is seen a notch 35 enabling the first pushing element 13 to pass through as well as a hole 36 disposed facing the guide element 12 and allowing the cord to pass through.

Figure 7:
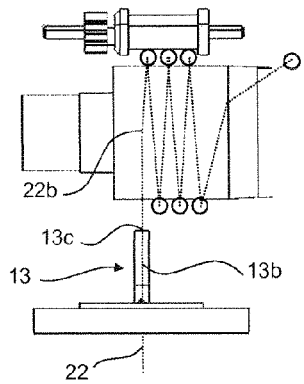
FIG. 7 shows a variant of cord entry guide element used in the cord winder of this embodiment of the invention.

FIG. 7 is a partial view analogous to that of FIG. 4 of a variant of the cord entry guide element.

In this preferred variant, the finger 13 completes the guide element 12 formed by the hole through which the cord arrives in the base 5. The cord is guided by a central face 13*b* of the finger. The profile of this central face 13*b* is such that a gap is produced between the winding drum and the central face 13*b* having a width slightly greater than the diameter of the cord. Accordingly, the rounded profile of the central face of the finger facilitates the movement of introduction of the cord onto the winding drum and minimize friction in the vicinity of the cord arrival hole. The central face of the finger may advantageously be conformed as a trough. Alternatively, the central face 13*b* may be integral with the support in order itself to comprise this cord guide function.

The cord thus penetrates into the winder in a plane perpendicular to the rotation axis of the drum and reaches an upper end 13*c* of the finger 13. At this level the cord penetrates into the helical groove, as indicated by the reference 22*b*.

When this variant is used, the cord winder comprises only one pushing element, namely the second pushing element.

Whatever pushing element is used, the behavior of the cord is such that it does not slide circumferentially on the winding drum in the winding area, although it slides axially.

The angle of winding of the cord onto the drum between the point of application of the rotary roller to the first turn of the cord and the first point of contact of the first turn with the drum is less than 180° in FIG. 4 and preferably less than 60°, typically 45°, in FIG. 7.

The construction of the cord winder of the invention therefore departs from the prior art devices to offer the considerable advantage of enabling the cord to be pushed out of the winder during an unwinding maneuver even in the absence of any load on the cord. Whereas prior art winders generally have at most one turn wound onto the winding drum, in a totally unwound position of the cord, the winder of the invention is such that the number of turns in the friction area is independent of the state of winding or of unwinding of the cord, which implies that in the totally unwound position at least this minimum number of turns remain wound onto the winding drum. FIG. 4 shows the position 22*a* of the cord in the storage area in a completely unwound position: the configuration of the cord between the guide element and the orientation element is on the other hand identical, whether the winding drum is totally wound or totally unwound.

Moreover, the cord winder of the invention also has the advantage of enabling regular winding of the cord into the winder even in the absence of any load on the cord. This particular feature is particularly useful in the case of window covering devices of very low mass or in the case of an involuntary movement of the user relieving the load bar during a winding phase. This moreover enables the mass of the load bar to be reduced.

The invention claimed is:

1. A cord winder for a window covering device, comprising a drum for winding a cord adapted to be driven in rotation about a first revolution axis, a first guide element for guiding the cord toward the winding drum, the winding drum being mounted to be mobile in rotation within a cylindrical bore of a support, a cord attachment element to receive an end of the cord such that the cord slides axially along the winding drum when wound on the drum, a rotary roller mounted on the support to rotate about a second revolution axis and wherein the drum comprises a friction area in which at least one turn of the cord wound on the winding drum is in contact with the rotary roller.

2. The cord winder claimed in claim 1, wherein the rotation of the rotary roller is slaved to the rotation of the winding drum by a slaving element.

3. A cord winder as claimed in claim 2, wherein the slaving element comprise a first pinion constrained to rotate with the winding drum and meshing with a second pinion constrained to rotate with the rotary roller.

4. A cord winder as claimed in claim 1 wherein, in the friction area, the rotary roller applies pressure to at least a first turn of the cord wound onto the winding drum.

5. A cord winder as claimed in claim 4, wherein the support comprises a second guide element for orienting the cord, the second guide element fastened to the support and disposed in the vicinity of the friction area in the direction away from the first guide element and at least two turns of cord of a final turn in contact with the rotary roller.

6. A cord winder as claimed in claim 5, wherein the number of turns in the friction area is independent of the state of winding or of unwinding of the cord.

7. A cord winder as claimed in claim 4, wherein the number of turns in the friction area is independent of the state of winding or of unwinding of the cord.

8. A cord winder as claimed in claim 1, wherein a pushing element acts at least on the turns in contact with the rotary roller to move the turns away from the guide element.

9. A cord winder as claimed in claim 8, wherein the pushing element comprise a helical wall.

10. A cord winder as claimed in claim 9, wherein the helical wall is formed in a cylindrical bore of the support, said cylindrical bore containing at least the friction area.

11. A cord winder as claimed in claim 1, wherein the rotary roller comprises a secondary shaft having two shaft ends (15*a*, 15*b*) that are guided into location in the support by two straight grooves provided in the support.

12. A cord winder as claimed in claim 1, wherein a pressing element pushes the rotary roller toward the drum.

13. A cord winder as claimed in claim 12, wherein the pressing element comprise an elastic element of the support in contact with a shaft end of the rotary roller.

14. A cord winder according to claim 1, wherein the rotary roller comprises an elastomer coating and/or a friction coating.

15. A cord winder as claimed in claim 1, wherein at most five consecutive turns of the cord are in tangential contact with the rotary roller.

16. A cord winder as claimed in claim 1, wherein the cord is guided toward the winding drum by a central face of a finger engaged in the support or belonging to the support.

* * * * *